US011308885B2

(12) United States Patent
Dong

(10) Patent No.: US 11,308,885 B2
(45) Date of Patent: Apr. 19, 2022

(54) DISPLAY PANEL FOR OUTPUTTING A SAME GATE SIGNAL TO TWO PIXELS ON DIFFERENT LINES AND DRIVING METHOD THEREOF

(71) Applicant: BOE TECHNOLOGY GROUP CO., LTD., Beijing (CN)

(72) Inventor: Tian Dong, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 205 days.

(21) Appl. No.: 16/618,894

(22) PCT Filed: Jun. 28, 2019

(86) PCT No.: PCT/CN2019/093671
§ 371 (c)(1),
(2) Date: Dec. 3, 2019

(87) PCT Pub. No.: WO2020/029711
PCT Pub. Date: Feb. 13, 2020

(65) Prior Publication Data

US 2021/0327360 A1 Oct. 21, 2021

(30) Foreign Application Priority Data

Aug. 8, 2018 (CN) ..... 201810897353.4

(51) Int. Cl.
*G09G 3/3266* (2016.01)
*G09G 3/3225* (2016.01)
*G09G 3/3275* (2016.01)

(52) U.S. Cl.
CPC ..... *G09G 3/3266* (2013.01); *G09G 3/3225* (2013.01); *G09G 3/3275* (2013.01);
(Continued)

(58) Field of Classification Search
CPC ..... G09G 3/3266
(Continued)

(56) References Cited

U.S. PATENT DOCUMENTS 6,366,026 B1 4/2002 Saito et al.
8,730,132 B2 5/2014 Choi et al.
(Continued)

FOREIGN PATENT DOCUMENTS

CN 1932939 A 3/2007
CN 102495503 A 6/2012
(Continued)

OTHER PUBLICATIONS

International Search Report dated Sep. 30, 2019, issued in counterpart application No. PCT/CN2019/093671 (10 pages).
(Continued)

*Primary Examiner* — Long D Pham
(74) *Attorney, Agent, or Firm* — WHDA, LLP

(57) ABSTRACT

The disclosure relates to a display panel. The display panel may include a pixel unit group and a scanning circuit. The pixel unit group may include a first pixel unit and a second pixel unit. The scanning circuit may include a first scan signal terminal and a second scan signal terminal. The first scan signal terminal may be configured to simultaneously provide a same gate signal to the first pixel unit and the second pixel unit, and/or the second scan signal terminal may be configured to simultaneously provide a same light emitting control signal to the first pixel unit and the second pixel unit.

18 Claims, 10 Drawing Sheets

(52) U.S. Cl.
CPC ..... *G09G 2300/043* (2013.01); *G09G 2310/0286* (2013.01); *G09G 2310/0297* (2013.01); *G09G 2320/0233* (2013.01)

(58) Field of Classification Search
USPC ..... 345/691
See application file for complete search history.

(56) References Cited

U.S. PATENT DOCUMENTS

| | | | | |
|---|---|---|---|---|
| 9,842,552 | B2 | 12/2017 | Han et al. | |
| 2004/0041754 | A1 | 3/2004 | Inukai | |
| 2012/0313903 | A1* | 12/2012 | Pyon | G09G 3/32 345/204 |
| 2016/0210892 | A1* | 7/2016 | Ohara | G09G 3/3266 |
| 2017/0069271 | A1* | 3/2017 | Kim | G09G 3/3233 |
| 2017/0287405 | A1* | 10/2017 | Tseng | G09G 3/3275 |
| 2019/0005905 | A1 | 1/2019 | Chen | |

FOREIGN PATENT DOCUMENTS

| | | | |
|---|---|---|---|
| CN | 102737580 | A | 10/2012 |
| CN | 103065556 | A | 4/2013 |
| CN | 103268753 | A | 8/2013 |
| CN | 103778881 | A | 5/2014 |
| CN | 104464601 | A | 3/2015 |
| CN | 105788529 | A | 7/2016 |
| CN | 106356026 | A | 1/2017 |
| CN | 107068101 | A | 8/2017 |
| JP | 2000-259124 | A | 9/2000 |

OTHER PUBLICATIONS

Office Action dated Aug. 17, 2020, issued in counterpart CN Application No. 201810897353.4, with English Translation. (21 pages).

* cited by examiner

Prior Art

DISPLAY PANEL FOR OUTPUTTING A SAME GATE SIGNAL TO TWO PIXELS ON DIFFERENT LINES AND DRIVING METHOD THEREOF

CROSS-REFERENCE TO RELATED APPLICATIONS

This application claims benefit of the filing date of Chinese Patent Application No. 201810897353.4 filed on Aug. 8, 2018, the disclosure of which is hereby incorporated in its entirety by reference.

TECHNICAL FIELD

Embodiments of the present disclosure relate to display technology, in particular, to a display panel, a driving method thereof, and a display apparatus.

BACKGROUND

Organic Light Emitting Diode (OLED) display panels are gradually gaining wide attention due to their advantages such as wide viewing angle, high contrast ratio, fast response speed, and higher light emitting brightness and lower driving voltage than inorganic light emitting display apparatus. Due to the above characteristics, the Organic Light Emitting Diode (OLED) display panel can be applied to an apparatus having a display function such as a mobile phone, a display, a notebook computer, a digital camera, an instrument meter, and the like.

BRIEF SUMMARY

An embodiment of the present disclosure provides a display panel. The display panel may include a pixel unit group and a scanning circuit. The pixel unit group may include a first pixel unit and a second pixel unit. The first pixel unit and the second pixel unit may respectively include a first pixel circuit and a second pixel circuit. The first pixel circuit may include a first gate control terminal and a first light emitting control terminal, and the second pixel circuit may include a second gate control terminal and a second light emitting control terminal. The scanning circuit may include a first scan signal terminal and a second scan signal terminal. The first scan signal terminal may be configured to simultaneously provide a same gate signal to the first pixel unit and the second pixel unit, and/or the second scan signal terminal may be configured to simultaneously provide a same light emitting control signal to the first pixel unit and the second pixel unit.

Optionally, the display panel may further include at least one gate line, wherein the first scan signal terminal is connected to the first gate control terminal and the second gate control terminal through the at least one gate line, and simultaneously provide the same gate signal to the first pixel unit and the second pixel unit through the at least one gate line.

Optionally, the display panel may further include at least one light emitting control line, wherein the second scan signal terminal is connected to the first light emitting control terminal and the second light emitting control terminal through the at least one light emitting control line, and simultaneously provide the same light emitting control signal to the first pixel unit and the second pixel unit.

Optionally, the display panel further includes a first data line and a second data line, wherein the first data line is connected to the first pixel circuit, and the second data line is connected to the second pixel circuit.

Optionally, the display panel further includes a multiplexing circuit and a data driving circuit, wherein the data driving circuit comprises a first data signal output terminal, the multiplexing circuit is connected to the first data signal output terminal, the first data line and the second data line, and is configured to electrically connect the first data signal output terminal to the first data line and the second data line in a time-multiplexing manner.

Optionally, the multiplexing circuit comprises a first selection circuit and a second selection circuit, a first terminal of the first selection circuit is connected to the first data line, a first terminal of the second selection circuit is connected to the second data line, and second terminals of both the first selection circuit and the second selection circuit are connected to the first data signal output terminal.

Optionally, the first selection circuit comprises a first multiplexing transistor, and the second selection circuit comprises a second multiplexing transistor; a first terminal and a second terminal of the first multiplexing transistor are respectively configured as the first terminal and the second terminal of the first selection circuit, and a first terminal and a second terminal of the second multiplexing transistor are respectively configured as the first terminal and the second terminal of the second selection circuit.

Optionally, a control terminal of the first multiplexing transistor and a control terminal of the second multiplexing transistor are configured to receive a same multiplexing control signal.

Optionally, the first multiplexing transistor and the second multiplexing transistor are of opposite types.

Optionally, the first multiplexing transistor and the second multiplexing transistor are of the same type.

Optionally, the multiplexing circuit further comprises an inverter, one terminal of the inverter is electrically connected to the control terminal of the second multiplexing transistor, and the other terminal of the inverter is configured to receive the same multiplexing control signal.

Optionally, a control terminal of the first multiplexing transistor and a control terminal of the second multiplexing transistor are configured to respectively receive a first multiplexing control signal and a second multiplexing control signal that are inverted from each other, and the first multiplexing transistor and the second multiplexing transistor are of the same type.

Optionally, the multiplexing circuit further comprises a multiplexing signal generating circuit, and the multiplexing signal generating circuit is configured to provide the same or inverted multiplexing control signal to the control terminals of the first multiplexing transistor and the second multiplexing transistor.

Optionally, the scanning circuit comprises a first scanning sub-circuit and a second scanning sub-circuit, the first scanning sub-circuit comprises the first scan signal terminal, and the second scanning sub-circuit comprises the second scan signal terminal.

Optionally, the first scan sub-circuit comprises a first shift register unit which is configured to be cascaded and comprise the first scan signal terminal, and the second scan sub-circuit comprises a second shift register unit which is configured to be cascaded and comprise the second scan signal terminal.

One embodiment of the present disclosure is a display apparatus, comprising the display panel according to one embodiment of the present disclosure.

One embodiment of the present disclosure is a method of driving the display panel according to one embodiment of the present disclosure. The method may include simultaneously providing the gate signal to the first gate control terminal and the second gate control terminal during a first period using the first scan signal terminal of the scanning circuit, the first period including a first sub-period and a second sub-period in sequence; and writing a first data signal to the first pixel circuit through the first data line and a second data signal to the second pixel circuit through the second data line during the first sub-period.

Optionally, writing the first data signal to the first pixel circuit through the first data line and the second data signal to the second pixel circuit through the second data line during the first sub-period comprises writing the first data signal to the first data line during a first write period and writing the first data signal to the first pixel circuit during the first sub-period; and writing the second data signal to the second data line during a second write period and writing the second data signal to the second pixel circuit during the first sub-period.

Optionally, the first write period is located before the first sub-period and is temporally adjacent to the first sub-period, and the second write period is located in the first sub-period; or the second write period is located before the first sub-period and is temporally adjacent to the first sub-period, and the first write period is located before the second write period and is temporally adjacent to the second write period.

Optionally, the method of driving the display panel further comprises providing simultaneously the same light emitting control signal to the first light emitting control terminal and the second light emitting control terminal using the second scan signal terminal of the scanning circuit in a second period.

Optionally, the display panel further comprises a multiplexing circuit and a data driving circuit, the data driving circuit comprising a first data signal output terminal, the driving method of the display panel further comprising connecting the first data line to the first data signal output terminal during the first write period to write the first data signal to the first data line; and connecting the second data line to the second data signal output terminal during the second write period to write the second data signal to the second data line.

BRIEF DESCRIPTION OF THE DRAWINGS

In order to more clearly illustrate the technical solutions of the embodiments of the present disclosure, the drawings of the embodiments will be briefly described below. It is obvious that the drawings in the following description relate only to some embodiments of the present disclosure, and are not to limit the disclosure.

DETAILED DESCRIPTION

In order to make the objects, technical solutions and advantages of the embodiments of the present disclosure more clear, the technical solutions of the embodiments of the present disclosure will be clearly and completely described below in conjunction with the drawings of the embodiments of the present disclosure. It is apparent that the described embodiments are part of the embodiments of the present disclosure, and not all of the embodiments. All other embodiments obtained by a person of ordinary skill in the art based on the described embodiments of the present disclosure without departing from the scope of the disclosure are within the scope of the disclosure.

Unless otherwise defined, the technical terms or scientific terms used herein should be understood in the ordinary sense as understood by those of ordinary skill in the art to which the disclosure pertains. The words "first," "second," and similar terms used in the present disclosure do not denote any order, quantity, or importance, but are used to distinguish different components. Similarly, "including" or "comprising" and the like means that the element or object appear in front of the word cover the elements or objects and their equivalents listed after the word, and the other elements or objects are not excluded. The words "connect" or "join" and the like are not limited to physical or mechanical connections, but may include electrical connections, whether direct or indirect. "Upper," "lower," "left," "right," etc. are only used to indicate the relative positional relationship, and when the absolute position of the object to be described is changed, the relative positional relationship may also change accordingly.

An OLED display apparatus typically includes a plurality of pixel units arranged in an array, each of which may include, for example, a pixel circuit. In the OLED display apparatus, the threshold voltage of the driving transistor in each pixel circuit may be different due to the fabrication process. For example, the threshold voltage of the driving transistor may be drifted due to a change in temperature. Therefore, the difference in threshold voltages of the respective driving transistors may cause poor display (for example, display non-uniformity). Thus, it is necessary to compensate the threshold voltages of the driving transistors.

Figure 1A:
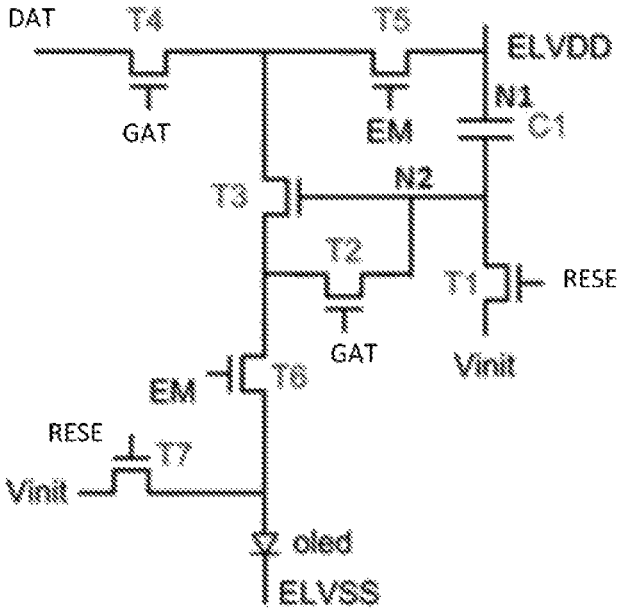
FIG. 1A is a schematic diagram of a pixel circuit in related art.

FIG. 1A shows a pixel circuit with threshold compensation capability in the related art. As shown in FIG. 1A, the pixel circuit is a 7T1C type pixel circuit, that is, a pixel circuit having seven transistors and one storage capacitor C1. Specifically, the pixel circuit includes a first transistor T1, a second transistor T2, a third transistor T3, a fourth transistor T4, a fifth transistor T5, a sixth transistor T6, a seventh transistor T7, a storage capacitor C1, and a light emitting element (for example, OLED), a first node N1, and a second node N2. The control terminals of the second transistor T2 and the fourth transistor T4 are configured as a gate control terminal GAT of the pixel circuit, and are connected to a gate line to receive a scan signal. The control terminals of the fifth transistor T5 and the sixth transistor T6 are configured as a light emitting control terminal EM of the pixel circuit, and are connected to a light emitting control line to receive a light emitting control signal. The control terminals of the first transistor T1 and the seventh transistor T7 are configured as a reset control terminal RESE of the pixel circuit, and are connected to a reset line to receive a reset signal. The control terminal of the third transistor T3 is respectively connected to the second node N2 and the first terminal of the storage capacitor C1. The first node N1 is connected to the first power terminal ELVDD. The second terminal of the light emitting element is connected to the second power terminal ELVSS. Here, the first power terminal ELVDD and the second power terminal ELVSS are respectively configured as constant voltage sources. In one embodiment, the voltage V1 output by the first power terminal ELVDD is, for example, greater than the voltage V2 output by the second power terminal ELVSS. The voltage V2 output by the ELVSS is, for example, zero (ground connection). The second terminal of the first transistor T1 and the first terminal of the seventh transistor T7 are configured to receive an initial voltage Vinit. The first terminal of the fourth transistor T4 is connected to a data signal receiving terminal DAT of the pixel circuit, and is connected to a data line to receive a data signal (for example, data voltage Vdata). In the pixel circuit, each transistor is a P-type transistor as an example, but the embodiments of the present disclosure are not limited to such a case. For example, at least one transistor in the pixel circuit may be an N-type transistor. The P-type transistor is turned on when a gate of the P-type transistor receives a low level signal below a threshold voltage, and turned off when the gate of the P-type transistor receives a high level signal above the threshold voltage.

Figure 1B:
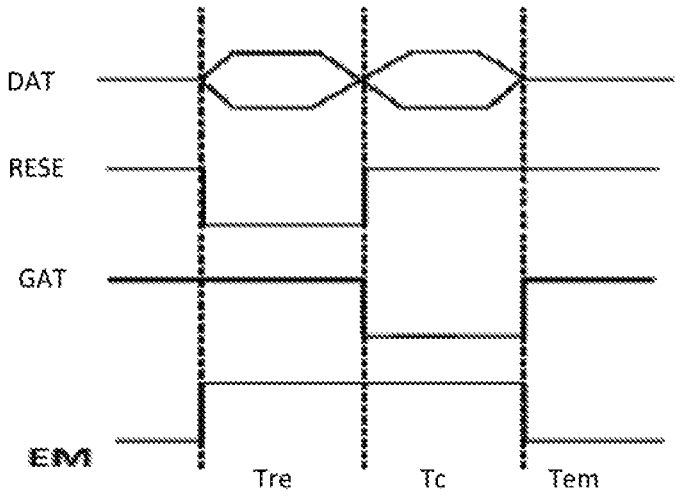
FIG. 1B is a driving timing chart of the pixel circuit shown in FIG. 1A.

FIG. 1B shows a driving timing chart of the pixel circuit shown in FIG. 1A. As shown in FIG. 1B, each driving period of the pixel circuit includes a reset phase $T_{re}$, a compensation phase $T_c$, and an emitting phase $T_{em}$.

In the reset phase $T_{re}$, the reset control terminal RSE of the pixel circuit receives a low level signal, whereby the first transistor T1 and the seventh transistor T7 are turned on. As such, the initial voltage Vinit is applied to the anode of the light emitting element and the second node N2 via the first transistor T1 and the seventh transistor T7 respectively, which are in an on state. As a result, the voltages of the anode of the light emitting element and the second node N2 are set to be the initial voltage Vinit, and accordingly reset. The initial voltage Vinit can turn on the third transistor T3 (driving transistor). At this time, the voltage of the first node N1 is V1.

In the compensation phase $T_c$, the gate control terminal GAT of the pixel circuit receives a low level signal, whereby the second transistor T2 and the fourth transistor T4 are turned on, thereby causing the data voltage Vdata to be applied to the source of the third transistor T3 and causing the drain and the gate of the third transistor T3 to be electrically connected. Since the third transistor T3 is in an on state, the storage capacitor C1 can be charged by the drain and the gate of the third transistor T3. The charging process is completed as the voltage of the gate of the third transistor T3 increases. At this time, the voltage Vt1 of the source (first terminal) of the third transistor T3 is Vdata, and the voltage Vt2 of the drain (second terminal) and the gate (control terminal) is changed to Vdata+Vth. That is, the voltage of the second node N2 is also Vdata+Vth, and is stored at the first terminal of the storage capacitor C1 (that is, the terminal connected to the second node N2). Here, Vth is the threshold voltage of the third transistor T3, and the voltage of the first node N1 is still V1.

In the light emitting phase $T_{em}$, the light emitting control terminal EM receives a low-level signal, whereby the fifth transistor T5 and the sixth transistor T6 are turned on. Thus, the first terminal of the third transistor T3 is connected to the first power terminal ELVDD via the turned-on fifth transistor T5. Accordingly, the voltage Vt1 of the first terminal of the third transistor T3 is changed to V1. At this time, under the action of the storage capacitor C1, the voltage Vtg at the control terminal of the third transistor T3, that is, the voltage of the second node N2 is still Vdata+Vth. The current $I_{ds}$ outputted by the third transistor T3 in a saturated state can be obtained by the following formula:

$$\begin{aligned} Ids &= 1/2 \times K(Vgs - Vth)^2 \\ &= 1/2 \times K(Vtg - Vt1 - Vth)^2 \\ &= 1/2 \times K(Vdata + Vth - V1 - Vth)^2 \\ &= 1/2 \times K(Vdata - V1)^2. \end{aligned}$$

Here, K=W/L×C×μ, W/L is the aspect ratio (i.e., the ratio of the width to the length) of the channel of the third transistor T3, μ is the electron mobility, and C is the capacitance per unit area.

As can be seen from the above formula, the current Ids output by the third transistor T3 in the saturated state is independent from the threshold voltage of the third transistor T3. Thus, the pixel circuit shown in FIG. 1A has a threshold compensation function.

However, the inventors of the present disclosure have discovered that when the refreshing rate of the display panel is increased (for example, from 60 Hz to 120 Hz), since the times (pulse) of the scan signal and the reset signal output from the gate driving circuit are reduced, the lengths of the reset phase $T_{re}$, the compensation phase $T_c$, and the light emitting phase $T_{em}$ are all reduced (eg, halved). At this time, since the time of the compensation phase $T_c$ is short, that is, the data writing time is short, the storage capacitor C1 cannot be sufficiently charged, thereby resulting in insufficient threshold voltage compensation capability of the pixel circuit. An exemplary illustration is provided with the pixel circuit shown in FIG. 1A as below. As shown in FIG. 1A, in the case where the time of the compensation phase $T_c$ is short, the voltage $V_{t2}$ of the control terminal of the third transistor T3 is difficult to sufficiently change to Vdata+Vth, and the voltage stored at the terminal of the storage capacitor C1 connected to the second node is not Vdata+Vth (eg, less than Vdata+Vth). In this case, the current Ids still has a certain relationship with the threshold voltage $V_{th}$ of the third transistor T3, thereby causing insufficient threshold voltage compensation capability of the pixel circuit, and reducing the compensation effect and brightness uniformity of the display panel.

Some embodiments of the present disclosure provide a display panel and a driving method thereof, and a display apparatus. The display panel may include a pixel unit group, a first data line, a second data line, at least one gate line, at least one light emitting control line, and a scanning circuit. The pixel unit group includes a first pixel unit and an adjacent second pixel unit. The first pixel unit and the second pixel unit include a first pixel circuit and a second pixel circuit respectively. The first pixel circuit includes a first gate control terminal and a first light emitting control terminal. The second pixel circuit includes a second gate control terminal and a second light emitting control terminal. The first data line is connected to the first pixel circuit. The second data line is connected to the second pixel circuit. The scanning circuit includes a first scan signal terminal and a second scan signal terminal. The first scan signal terminal is connected to the first gate control terminal and the second gate control terminal through at least one gate line, and the second scan signal terminal is connected to the first light emitting control terminal and the second light emitting control terminal through at least one light emitting control line. The display panel, the driving method thereof, and the display apparatus according to some embodiments of the present disclosure can still ensure sufficient threshold compensation capability of the display panel when the refreshing frequency of the display panel is high, thereby improving the compensation effect and the brightness uniformity of the display panel and the display apparatus.

The display panels provided according to some embodiments of the present disclosure are illustrated below using a few examples. As described below, if not conflicting with one another, different features in these specific examples may be recombined with one another to form some new examples. These new examples are also within the scope of protection of the present disclosure.

Figure 2:
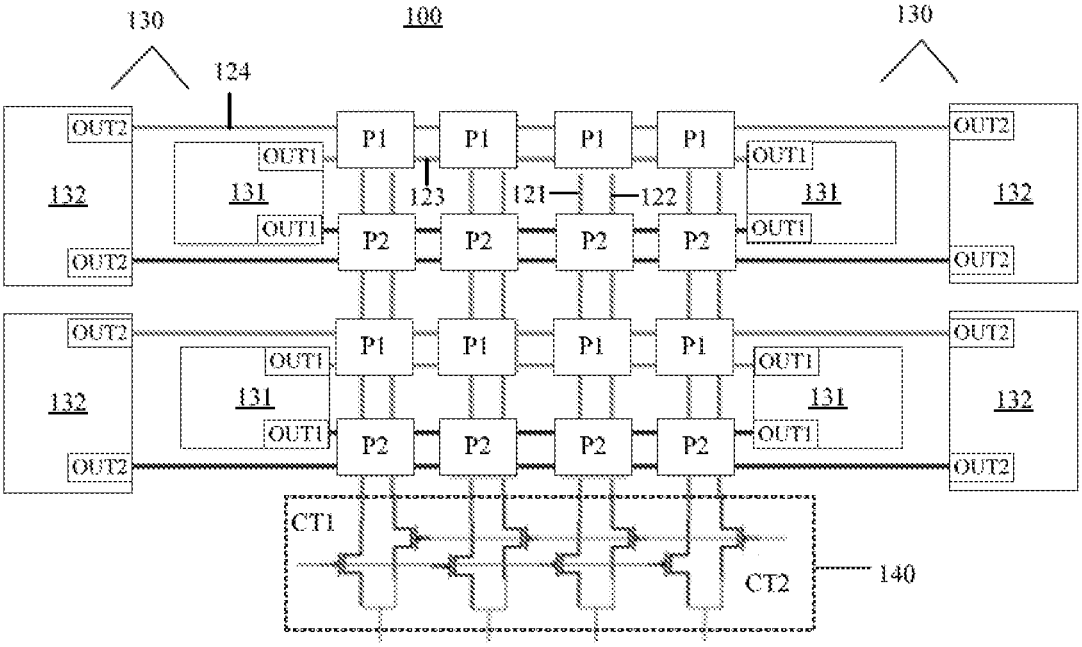
FIG. 2 is a schematic view of a display panel according to some embodiments of the present disclosure.

FIG. 2 is a schematic diagram of a display panel 100 according to one embodiment of the present disclosure. As shown in FIG. 2, the display panel 100 includes a plurality of pixel unit groups, a first data line 121, a second data line 122, at least one gate line 123, at least one light emitting control line 124, and scanning circuits 130 for the pixel unit groups. The plurality of pixel unit groups constitutes a pixel array of a plurality of rows and columns.

In some embodiments, as shown in FIG. 2, a pixel unit group includes a first pixel unit P1 and an adjacent second pixel unit P2. The first pixel unit P1 and the second pixel unit P2 are adjacent, for example, in an extension direction of the first data line 121. Therefore, the first pixel unit P1 and the second pixel unit P2 are located at different rows in a same column. The first pixel unit P1 and the second pixel unit P2 respectively include a first pixel circuit 111 and a second pixel circuit 112 (not shown in FIG. 2, see FIG. 3). The first data line 121 is connected to the first pixel circuit 111 for providing a data voltage signal to the first pixel circuit 111. The second data line 122 is connected to the second pixel circuit 112 for providing a data voltage signal to the second pixel circuit 112. Here, the first pixel circuit 111 and the second pixel circuit 112 may have the same structure such as the pixel circuit as shown in FIG. 1A, but the embodiments of the present disclosure are not limited thereto as long as they control the compensation time by the gating signal.

It should be noted that, in the embodiments of the present disclosure, the adjacent first pixel unit P1 and second pixel unit P2 means that no other pixel unit is disposed between the first pixel unit P1 and the second pixel unit P2. Correspondingly, no other pixel circuit is provided between the first pixel circuit 111 and the second pixel circuit 112.

In some embodiments, as shown in FIG. 2, the scanning circuit 130 includes a first scan signal terminal OUT1 and a second scan signal terminal OUT2. The first scan signal terminal OUT1 of the scanning circuit 130 is connected to the first pixel unit P1 and the second pixel unit P2 through the gate line 123, and provides a same gating signal to the first pixel unit P1 and the second pixel unit P2. The second scan signal terminal OUT2 of the scan circuit 130 is connected to the first pixel unit P1 and the second pixel unit P2 through the light emitting control line 124, and provides a same light emitting control signal to the first pixel unit P1 and the second pixel unit P2.

In some embodiments, as shown in FIG. 2, the display panel 100 further includes a multiplexing circuit 140 which is connected to the first data line 121 and the second data line 122, and is configured to distribute data signals from a data driving circuit (not shown in the FIG. 2, see FIG. 3) to the first data line 121 and the second data line 122 at different times.

In some embodiments, the first scan signal terminal OUT1 of the scanning circuit 130 is simultaneously connected to the first pixel circuit 111 and the second pixel circuit 112 through the gate line 123 and simultaneously provides a same gate signal to the first pixel circuit 111 and the second pixel circuit 112. Thus, the threshold voltage compensation of the first pixel circuit 111 and the second pixel circuit 112 can be performed in a same period of time. As such, the length of time of the compensation phase of the pixel circuit is increased (for example, the time length is doubled). Accordingly, the threshold voltage compensation capability of the display panel 100 provided by the embodiments of the present disclosure is improved, thereby improving the compensation effect and brightness evenness of the display panel 100. Based on this, the display panel 100 provided by some embodiments of the present disclosure is suitable for an application in which the refreshing frequency of the display panel 100 is high (for example, a virtual display, an enhanced display, and the like).

The display panel 100 provided by some embodiments of the present disclosure will be specifically described below by taking the display panel 100 shown in FIG. 3 as an example.

Figure 3:
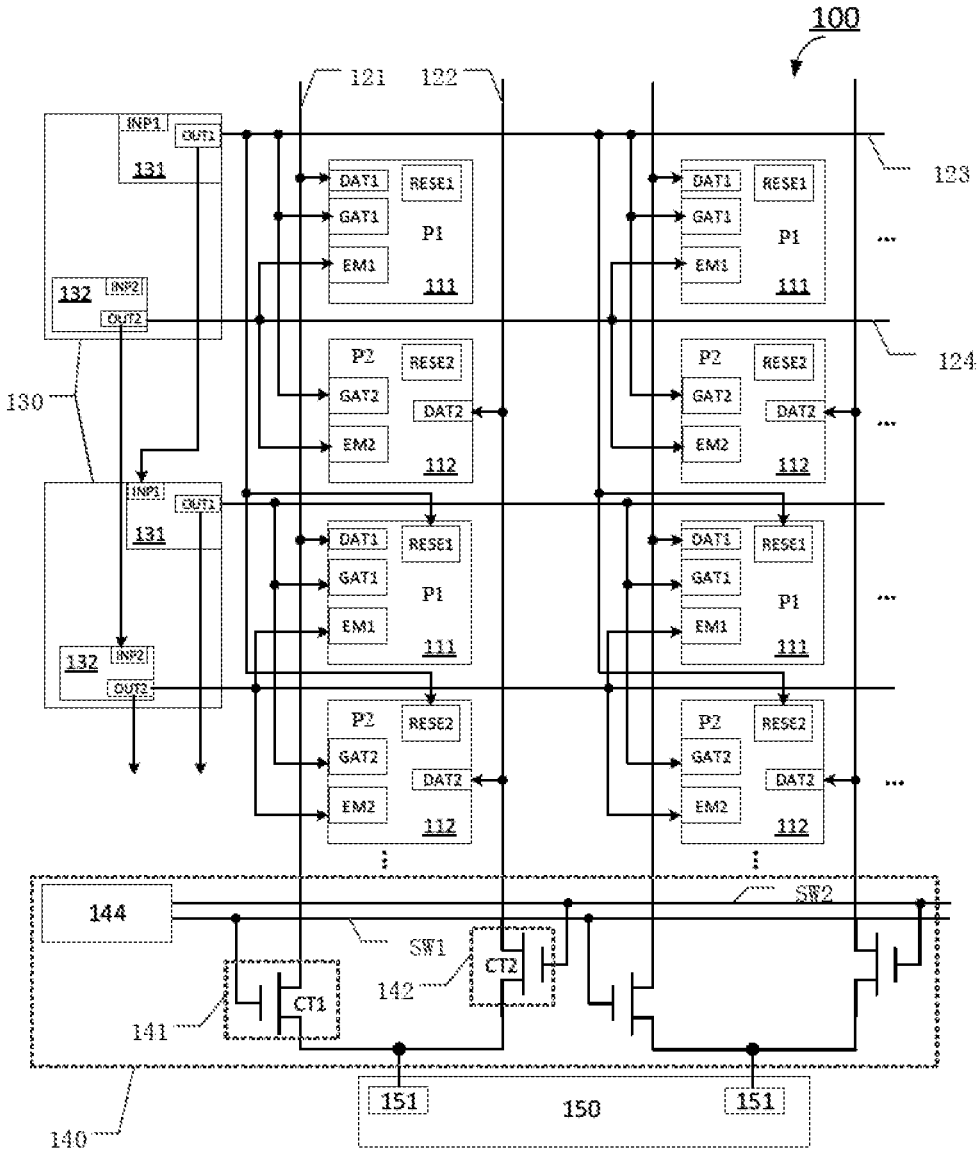
FIG. 3 is a schematic diagram of a display panel according to some embodiments of the present disclosure.

As shown in FIG. 3, the display panel 100 includes a plurality of pixel unit groups and a first data line 121, a second data line 122, at least one gate line 123, at least one light emitting control line 124, and scanning circuits 130 for the pixel unit groups. The pixel unit group includes a first pixel unit P1 and an adjacent second pixel unit P2 (adjacent in the extension direction of the first data line 121). The first pixel unit P1 and the second pixel unit P2 respectively include a first pixel circuit 111 and a second pixel circuit 112. The first pixel circuit 111 and the second pixel circuit 112 can be, for example, a 7T1C type pixel circuit as shown in FIG. 1A, a 6T1C type pixel circuit, a 5T2C type pixel circuit, or other type of pixel circuit having a threshold compensation function.

A plurality of pixel unit groups constitutes a pixel array of a plurality of rows and columns. In some embodiments, as shown in FIG. 3, the first pixel unit P1 and the second pixel unit P2 of each pixel unit group are respectively located in a same column but in different rows, for example, in an odd row and an even row, respectively.

In some embodiments, as shown in FIG. 3, the first pixel circuit 111 includes a first gate control terminal GAT1, a first light emitting control terminal EM1, a first reset control terminal RESE1, and a first data signal receiving terminal DAT1. The second pixel circuit 112 includes a second gate control terminal GAT2, a second light emitting control terminal EM2, a second reset control terminal RESE2, and a second data signal receiving terminal DAT2. The first data line 121 is connected to the first data signal receiving terminal DAT1 of the first pixel circuit 111, and the second data line 122 is connected to the second data signal receiving terminal DAT2 of the second pixel circuit 112.

In some embodiments, the first gate control terminal GAT1 and the second gate control terminal GAT2 are two spatially separated control terminals. The first light emitting control terminal EM1 and the second light emitting control terminal EM2 are two spatially separated control terminals. The first reset control terminal RESE1 and the second reset control terminal RESE2 are two spatially separated control terminals.

In some embodiments, as shown in FIG. 3, the scanning circuit 130 includes a first scanning sub-circuit 131 and a second scanning sub-circuit 132. The first scanning sub-circuit 131 includes a first scanning signal terminal OUT1 for outputting a scanning signal (and a reset signal). The second scanning sub-circuit 132 includes a second scan signal terminal OUT2 for outputting a light emitting control signal. In one embodiment, the scanning circuit 130 can be realized by a semiconductor chip, which is connected to the gate line and the light emitting control line by binding. Alternatively, the scanning circuit 130 can be formed on a same substrate (array substrate) as the pixel array by a GOA method. For example, for the GOA method, the first scanning sub-circuit 131 includes a first shift register unit (not shown) that is configured to be cascaded and includes a first scan signal terminal OUT1. The second scanning sub-circuit 132 includes a second shift register unit (not shown) that is configured to be cascaded and includes a second scan signal terminal OUT2.

In some embodiments, the first scan signal terminal OUT1 is connected to the first gate control terminal GAT1 and the second gate control terminal GAT2 through at least one gate line 123. As such, the first scan signal terminal OUT1 may provide the same gate signals (Vgat1, Vgat2, . . . ) to a first gate control terminal GAT1 and the second gate control terminal GAT2 simultaneously in the first time period t1. The second scanning signal terminal OUT2 is connected to the first light emitting control terminal EM1 and the second light emitting control terminal EM2 through at least one light emitting control line 124. As such, the second scanning signal terminal OUT2 may provide the same light emitting control signals (Vem1, Vem2, . . . ) to the first light emitting control terminal EM1 and the second light emitting control terminal EM2 simultaneously in a second time period t2.

In some embodiments, as shown in FIG. 3, the pixel unit groups are repeatedly arranged in the extension direction of the first data line 121 and the extension direction of the gate line 123. In one embodiment, the display panel 100 includes N pixel unit groups in the extension direction of the first data line 121. The first scanning sub-circuit 131 is repeatedly arranged and sequentially cascaded in the extension direction of the first data line 121, and the second scanning sub-circuit 132 is repeatedly arranged and sequentially cascaded in the extension direction of the first data line 121.

In some embodiments, as shown in FIG. 3, the first scan signal terminal OUT1 of the m-th scanning circuit 130 is connected to the first gate control terminal GAT1 and the second gate control terminal GAT2 of the pixel unit group of the m-th row. Furthermore, the first scan signal terminal OUT1 of the m-th scanning circuit 130 is also connected to the first reset control terminal RESE1 and the second reset control terminal RESE2 of the pixel unit group of the m+1th row, and simultaneously provides the same reset control signal to the first reset control terminal RESE1 and the second reset control terminal RESE2 of the pixel unit group of the m+1th row, wherein m is greater than or equal to 1 and less than N. Thereby, the first reset control terminal RESE1 of the first pixel circuit 111 and the second reset control terminal RESE2 of the second pixel circuit 112 can receive the reset control signal (Vrese1, Vrese2 . . . ) during the third time period t3 before the first time period t1, and performs a reset operation on the first pixel circuit 111 and the second pixel circuit 112. It should be noted that the first reset control terminal RESE1 and the second reset control terminal RESE2 of the pixel unit group are not limited to being electrically connected to the first scan signal terminal OUT1. In another embodiment, the scanning circuit 130 can also include a third scanning sub-circuit (not shown) and the third scanning sub-circuit includes a third shift register unit. The third shift register unit is configured to be cascaded and includes a third scan signal terminal. The third scan signal terminal of the m-th scanning circuit 130 is connected to the first reset control terminal RESE1 and the second reset control terminal RESE2 of the pixel unit group of the m-th row.

In some embodiments, as shown in FIG. 3, the display panel 100 further includes a multiplexing circuit 140 and a data driving circuit 150. The data driving circuit 150 includes a first data signal output terminal 151. The multiplexing circuit 140 is connected to the first data signal output terminal 151, the first data line 121 and the second data line 122. The multiplexing circuit 140 is configured to electrically connect the first data signal output terminal 151 to the first data line 121 and the second data line 122 at different times, that is, in a time-multiplexing manner, thereby applying a data voltage signal to the first data line 121 and the second data line 122, respectively at different times. The data driving circuit 150 can be realized, for example, by a semiconductor chip which is connected to a corresponding signal line by means of binding.

Figure 4:
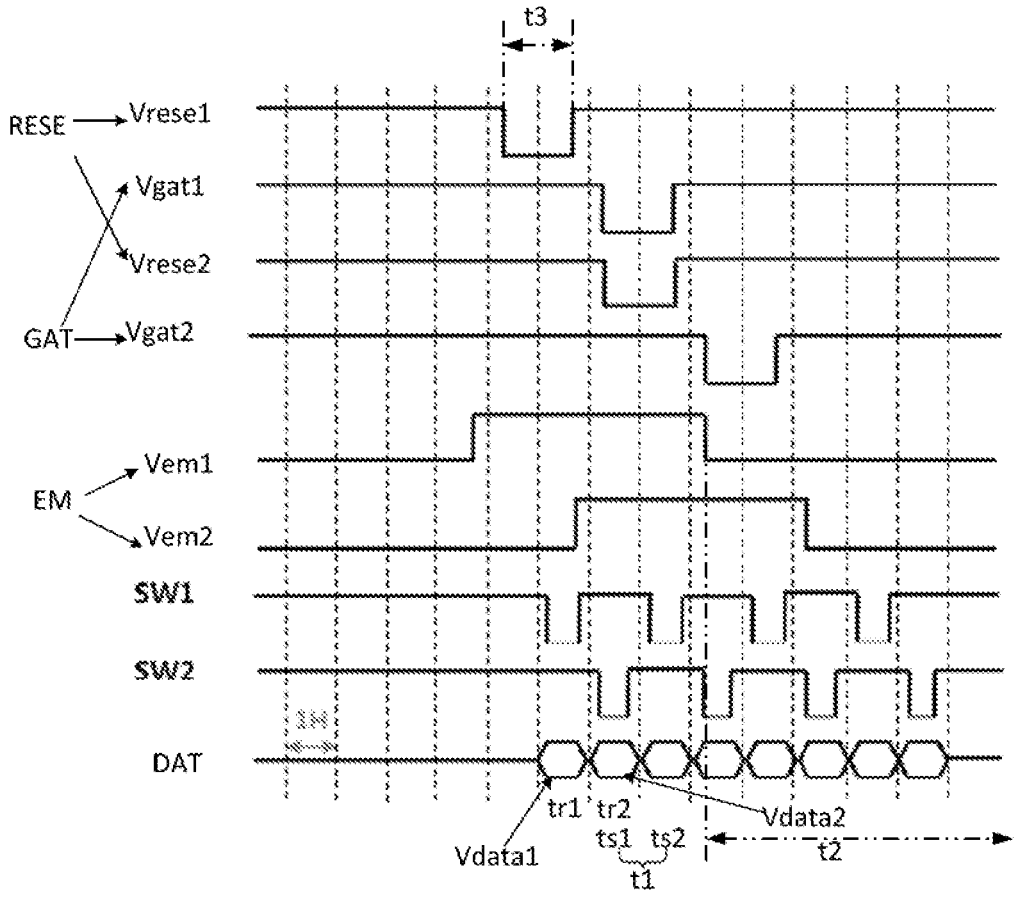
FIG. 4 is a driving timing chart of the display panel shown in FIG. 3 according to some embodiments of the present disclosure.

FIG. 4 is a driving timing chart of the display panel shown in FIG. 3 according to one embodiment of the present disclosure. As shown in FIG. 4, the first time period t1 sequentially includes a first sub-period ts1 and a second sub-period ts2. In a first write period tr1 located before and temporally adjacent to the first sub-period ts1, the multiplexing circuit 140 is configured to connect the first data line 121 to the first data signal output terminal 151 to write the first data signal $V_{data1}$ to the first data line 121 and, for example, store the first data signal Vdata1 in a parasitic capacitor connected to the first data line 121 or a separately disposed storage capacitor (not shown). In the second write period tr2 located in the first sub-period ts1, the multiplexing circuit 140 is configured to connect the second data line 122 to the first data signal output terminal to write the second data signal Vdata2 to the second data line 122 and, for example, store the second data signal Vdata2 in a parasitic capacitor connected to the second data line 122 or a separately disposed storage capacitor (not shown). In one embodiment, both the first write period tr1 and the second write period tr2 are equal to or less than half of the first period t1. Both the first sub-period ts1 and the second sub-period ts2 are equal to or less than half of the first period t1. In one embodiment, the time lengths of the first write period tr1, the second write period tr2, the first sub-period ts1 and the second sub-period ts2 are respectively 1H, and the time length of the first time period t1 is 2H.

In some embodiments, as shown in FIG. 4, in the first sub-period ts1 and the second sub-period ts2, a same low-level signal is simultaneously supplied to the first gate control terminal GAT1 and the second gate control terminal GAT2. As such, the first data signal Vdata1 can be written to the first pixel circuit 111 through the first data line 121 in the first sub-period ts1, and the second data signal Vdata2 can also be written to the second pixel circuit 112 through the second data line 122 in the first sub-period ts1. Thus, in the same period of time (that is, the first sub-period ts1 and the second sub-period ts2), threshold voltage compensation is performed on the first pixel circuit 111 and the second pixel circuit 112. Therefore, the display panel 100 provided by some embodiments of the present disclosure increases the time length of the compensation phase of the pixel circuit (for example, doubling the time length) and improves the threshold voltage compensation capability, thereby improving the compensation effect and the brightness evenness.

It should be noted that the relationship between the first write period tr1 or the second write period tr2 with the first sub-period ts1 is not limited to the relationship shown in FIG. 4. According to actual application requirements, the second write period tr2 may also be located before and temporally adjacent to the first sub-period ts1. The first write period tr1 may also be located before and temporally adjacent to the second write period tr2.

The specific structure of the multiplexing circuit 140 can be set according to actual application requirements, and the embodiments of the present disclosure do not specifically limit this.

In some embodiments, the multiplexing circuit 140 provided by some embodiments of the present disclosure may be implemented with the multiplexing circuit 140 shown in FIG. 3. As shown in FIG. 3, the multiplexing circuit 140 includes a first selection circuit 141, a second selection circuit 142, a first multiplexing control line SW1, a second multiplexing control line SW2, and a multiplexed signal generating circuit 144. The first terminal of the first selection circuit 141 is connected to the first data line 121. The first terminal of the second selection circuit 142 is connected to the second data line 122. The second terminals of the first selection circuit 141 and the second selection circuit 142 are both connected to the first data signal output terminal 151.

The specific configuration of the first selection circuit 141 and the second selection circuit 142 may be set according to actual application requirements, and the embodiments of the present disclosure do not specifically limit this. For example, the first selection circuit 141 and the second selection circuit 142 provided by some embodiments of the present disclosure may be implemented with the structure shown in FIG. 3.

In some embodiments, as shown in FIG. 3, the first selection circuit 141 includes a first multiplexing transistor CT1. The second selection circuit 142 includes a second multiplexing transistor CT2. The first multiplexing transistor CT1 and the second multiplexing transistor CT2 are of the same type (for example, both are P-type transistors). In the example shown in FIG. 3, the first terminal and the second terminal of the first multiplexing transistor CT1 are respectively configured as a first terminal and a second terminal of the first selection circuit 141. The first terminal and the second terminal of the second multiplexing transistor CT2 are respectively configured as a first terminal and a second terminal of the second selection circuit 142.

In some embodiments, as shown in FIG. 3, the control terminal of the first multiplexing transistor CT1 is connected to the first multiplexing control line SW1. The control terminal of the second multiplexing transistor CT2 is connected to the second multiplexing control line SW2. The multiplexed signal generating circuit 144 is configured to provide a first multiplexing control signal to the control terminal of the first multiplexing transistor CT1 via the first multiplexing control line SW1, and to provide a second multiplexing control signal to the control terminal of the second multiplexing transistor CT2 via the second multiplexing control line SW2. As shown in FIG. 4, the low levels of the first multiplexing control signal and the second multiplexing control signal may have the same waveform, but differ from each other by half a cycle. Therefore, the low-level pulse portion of the first multiplexing control signal and the low-level pulse portion of the second multiplexing control signal do not overlap in time. As such, the first multiplexing transistor CT1 and the second multiplexing transistor CT2 are turned on at different times (for example, turned on in the first write period tr1 and the second write period tr2 respectively). Accordingly, the multiplexing circuit 140 may electrically connect the first data signal output terminal 151 to the first data line 121 and the second data line 122 at different times, that is, in a time-multiplexing manner. In one embodiment, the first multiplexing control signal and the second multiplexing control signal may be inverted from each other. The multiplexing signal generating circuit 144 can be implemented in various suitable manners, such as by programming for an FPGA, and the like.

The display panel 100 driving process and the threshold compensation principle provided by some embodiments of the present disclosure are exemplified in the following with reference to FIG. 4. The first pixel circuit 111 and the second pixel circuit 112 are implemented with the 7T1C type pixel circuit shown in FIG. 1A as an example.

In some embodiments, as shown in FIG. 4, in the third period t3, the reset control terminal RESE1 of the first pixel circuit 111 receives a low level signal and the reset control terminal RESE2 of the second pixel circuit 112 receives a high level signal, so that the first transistor T1 and the seventh transistor T7 of the first pixel circuit 111 and the first transistor T1 and the seventh transistor T7 of the second pixel circuit 112 are all turned on. As such, the initial voltage Vinit is applied to the anode of the light emitting element and the second node N2 via the first transistor T1 and the seventh transistor T7, respectively. Accordingly, the voltages of the anode of the light emitting element and the second node N2 are set to the initial voltage Vinit and thus reset. The initial voltage Vinit can cause the third transistor T3 (driving transistor) to be in an on state. At this time, the voltage of the first node N1 is V1.

In some embodiments, as shown in FIG. 4, in the first period t1, the gate control terminal GAT1 of the first pixel circuit 111 and the gate control terminal GAT2 of the second pixel circuit 112 receive a low level signal, so that the second transistor T2 and the fourth transistor T4 of the first pixel circuit 111 and the second transistor T2 and the fourth transistor T4 of the second pixel circuit 112 are all turned on.

In some embodiments, as shown in FIG. 4, in the first write period tr1, the multiplexing signal generating circuit 144 supplies a low level signal to the control terminal of the first multiplexing transistor CT1 and turns on the first multiplexing transistor CT1. Thereby, the first data signal output terminal 151 is connected to the first data line 121, and the first data signal Vdata1 is written to the first data line 121. The data signal Vdata1 is stored in a parasitic capacitor or a separately provided storage capacitor (not shown). Since the second transistor T2 and the fourth transistor T4 of the first pixel circuit 111 are both in the on state in the first sub-period ts1 and the second sub-period ts2, the first data signal Vdata1 stored in the storage capacitor C1 is written to the first terminal of the third transistor T3 of the first pixel circuit 111 in the first sub-period ts1. As such, the voltage Vt1 of the first terminal of the third transistor T3 of the first pixel circuit 111 is Vdata1. Furthermore, in the first sub-period ts1 and the second sub-period ts2, the voltage Vt2 of the control terminal of the third transistor T3 of the first pixel circuit 111 is changed to Vdata1+Vth1, and is stored on one terminal of the storage capacitor C1 of the first pixel circuit 111 connected to the second node N2. Here, Vth1 is the threshold voltage of the third transistor T3 of the first pixel circuit 111.

In some embodiment, as shown in FIG. 4, in the second write period tr2 (that is, the first sub-period ts1), the multiplexing signal generating circuit 144 supplies a low level signal to the control terminal of the second multiplexing transistor CT2 and turns on the second multiplexing transistor CT2. Thereby, the first data signal output terminal 151 is connected to the second data line 122, and the second data signal Vdata2 is written to the second data line 122. The signal Vdata2 is stored in a parasitic capacitor or a separately provided storage capacitor (not shown). Since the second transistor T2 and the fourth transistor T4 of the second pixel circuit 112 are both in the on state in the first sub-period ts1 and the second sub-period ts2, the second data signal Vdata2 stored in the storage capacitor C1 is written to the first terminal of the third transistor T3 of the second pixel circuit 112 in the first sub-period ts1. Thus, the voltage Vt1 of the first terminal of the third transistor T3 of the second pixel circuit 112 is Vdata2. The voltage Vt2 of the control terminal of the third transistor T3 of the second pixel circuit 112 is changed to Vdata2+Vth2, and is stored on one terminal of the storage capacitor C1 of the second pixel circuit 112 connected to the second node N2. Here, Vth2 is the threshold voltage of the third transistor T3 of the second pixel circuit 112.

In some embodiments, as shown in FIG. 4, in the second time period t2, the light emitting control terminal EM1 of the first pixel circuit 111 and the light emitting control terminal EM2 of the second pixel circuit 112 both receive a low level signal, so that the fifth transistor T5 and the sixth transistor T6 of the first pixel circuit 111 and the fifth transistor T5 and the sixth transistor T6 of the second pixel circuit 112 are all turned on. Further, the voltage Vt1 of the first terminal and the voltage Vtg of the control terminal of the third transistor of the first pixel circuit 111 are V1 and Vdata1+Vth1, respectively. The third transistor T3 of the first pixel circuit 111 in a saturated state outputs the current $Ids1=\frac{1}{2}\times K(Vdata1-V1)^2$. The voltage Vt1 of the first terminal and the voltage Vtg of the control terminal of the third transistor of the second pixel circuit 112 are V1 and Vdata2+Vth2, respectively. The third transistor T3 of the second pixel circuit 112 in a saturated state outputs the current $Ids2=\frac{1}{2}\times K(Vdata2-V1)^2$. Therefore, the current Ids1 output by the third transistor T3 of the first pixel circuit 111 in the saturated state is independent from the threshold voltage Vth1 of the third transistor T3 of the first pixel circuit 111. The current Ids2 output by the third transistor T3 of the second pixel circuit 112 in the saturated state is independent from the threshold voltage Vth2 of the third transistor T3 of the second pixel circuit 112. That is, the display panel 100 provided by some embodiments of the present disclosure has a threshold voltage compensation function.

Since the gate control terminal GAT1 of the first pixel circuit 111 and the gate control terminal GAT2 of the second pixel circuit 112 are both turned on during the first period t1, and the first data signal Vdata1 and the second data signal Vdata2 may be written into the first pixel circuit 111 and the second pixel circuit 112, respectively, in the first sub-period ts1. Therefore, the voltage Vt2 of the control terminal of the third transistor T3 of the first pixel circuit 111 can be changed to Vdata1+Vth1 in the first sub-period ts1 and the second sub-period ts2, and be stored on the terminal of the storage capacitor C1 of the first pixel circuit 111 connected to the second node N2 via the turned-on second transistor T2. The voltage Vt2 of the control terminal of the third transistor T3 of the second pixel circuit 112 can be changed to Vdata2+Vth2 in the first sub-period ts1 and the second sub-period ts2, and be stored on the terminal of the storage capacitor C1 of the second pixel circuit 112 connected to the second node N2 via the turned-on second transistor T2. Thereby, both the first pixel circuit 111 and the second pixel circuit 112 can perform threshold compensation in the first sub-period ts1 and the second sub-period ts2. Accordingly, the display panel 100 provided by some embodiments of the present disclosure increases the time length of the compensation phase of the pixel circuits (for example, doubling the time length), and improves the threshold voltage compensation capability, thereby improving the compensation effect and the brightness evenness.

Figure 5:
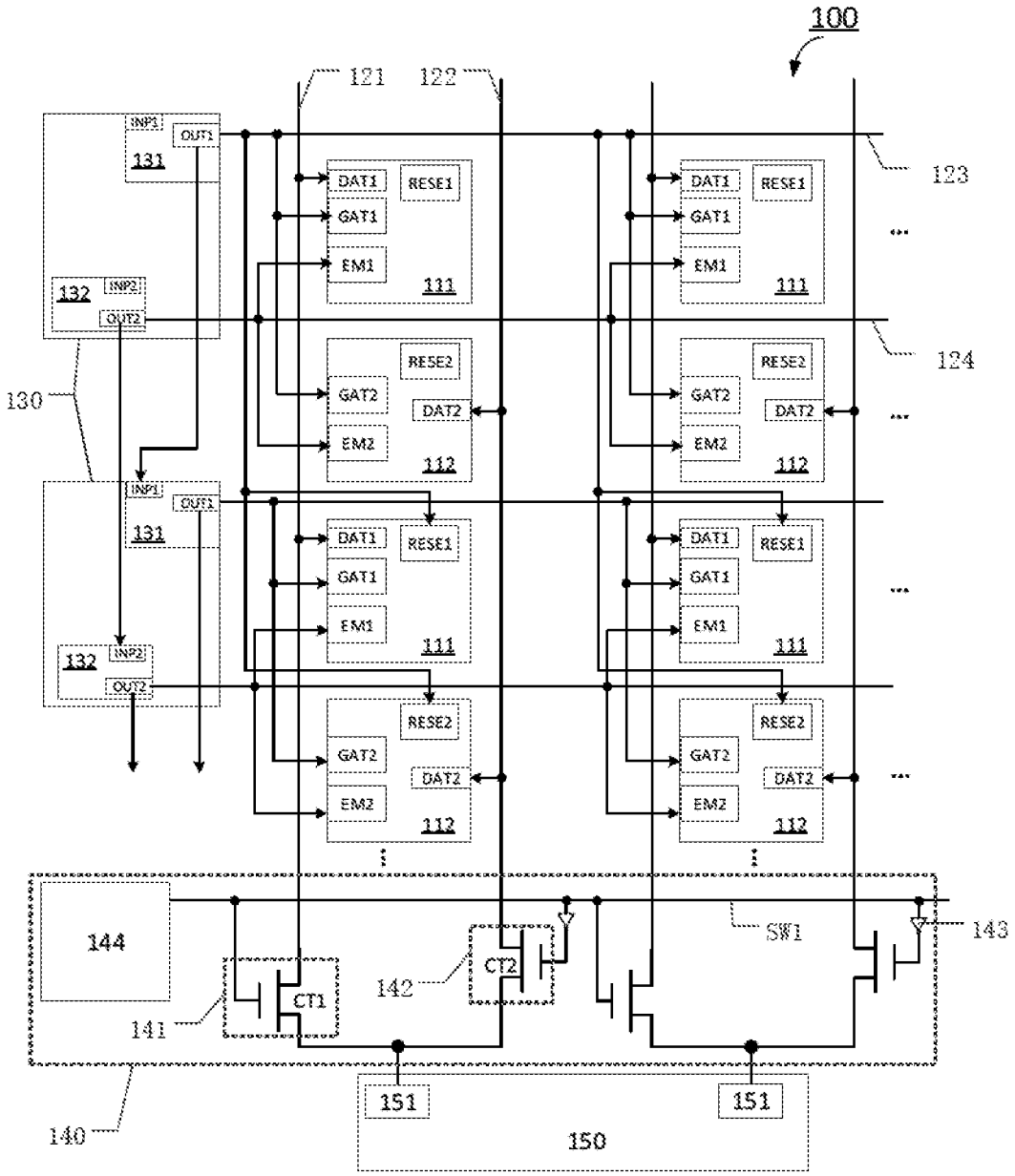
FIG. 5 is a schematic diagram of a display panel according to some embodiments of the present disclosure.

In some embodiments, the multiplexing circuit 140 may be implemented with the multiplexing circuit 140 illustrated in FIG. 5. As shown in FIG. 5, the multiplexing circuit 140 includes a first selection circuit 141, a second selection circuit 142, a first multiplexing control line SW1, an inverter 143, and a multiplexing signal generation circuit 144. The first terminal of the first selection circuit 141 and the first terminal of the second selection circuit 142 are connected to the first data line 121 and the second data line 122, respectively. The second terminal of the first selection circuit 141 and the second terminal of the second selection circuit 142 are both connected to the first data signal output terminal 151. The control terminal of the first selection circuit 141 is connected to the first multiplexing control line SW1. The control terminal of the second selection circuit 142 is connected to the first multiplexing control line SW1 via the inverter 143.

In some embodiments, as shown in FIG. 5, the first selection circuit 141 includes a first multiplexing transistor CT1, and the second selection circuit 142 includes a second multiplexing transistor CT2. Furthermore, the first multiplexing transistor CT1 and the second multiplexing transistor CT2 are of the same type (for example, both are P-type transistors). In the example shown in FIG. 5, the first terminal and the second terminal of the first multiplexing transistor CT1 are respectively configured as a first terminal and a second terminal of the first selection circuit 141. The first terminal and the second terminal of the second multiplexing transistor CT2 are respectively configured as a first terminal and a second terminal of the second selection circuit 142. The control terminal of the first multiplexing transistor CT1 is connected to the first multiplexing control line SW1, and the control terminal of the second multiplexing transistor CT2 is connected to the first multiplexing control line SW1 via the inverter 143.

The inverter 143 is configured to invert the received multiplexing control signal and provide it to the control terminal of the second multiplexing transistor CT2. The inverter 143 can be any circuit structure that implements the signal inversion function. Therefore, the signals received by the control terminal of the first selection circuit 141 and the control terminal of the second selection circuit 142 are inverted from each other. Thereby, the first multiplexing transistor CT1 and the second multiplexing transistor CT2 are turned on at different times (for example, turned on respectively in the first write period tr1 and the second write period tr2). Further, the multiplexing circuit 140 may electrically connect the first data signal output terminal 151 with the first data line 121 and the second data line 122 at different times, that is, in a time-multiplexing manner.

For the multiplexing circuit 140 shown in FIG. 5, the types of the first multiplexing transistor CT1 and the second multiplexing transistor CT2 may be opposite (for example, a P-type transistor and an N-type transistor, respectively). At this time, the control terminal of the first multiplexing transistor CT1 and the control terminal of the second multiplexing transistor CT2 may both be connected to the first multiplexing control line SW1 (that is, the inverter 143 need not be provided), and be configured to receive the same multiplexing control signals. Since the types of the first multiplexing transistor CT1 and the second multiplexing transistor CT2 are opposite, and the control terminal of the first multiplexing transistor CT1 and the control terminal of the second multiplexing transistor CT2 receive the same multiplexing control signal, therefore, the first multiplexing transistor CT1 and the second multiplexing transistor CT2 are turned on at different times. In one embodiment, the first multiplexing transistor CT1 and the second multiplexing transistor CT2 are turned on in the first write period tr1 and the second write period tr2 respectively. Further, the multiplexing circuit 140 may electrically connect the first data signal output terminal 151 with the first data line 121 and the second data line 122 in a time-multiplexing manner.

There are following points that need to be explained.

(1) For the sake of clarity, the display panel 100 shown in FIG. 3 and FIG. 5 only exemplarily shows two rows and two columns of pixel unit groups. The number of pixel unit groups included in the display panel 100 can be set according to actual application requirements.

(2) FIG. 3 and FIG. 5 each illustrate a display panel 100 according to some embodiments of the present disclosure by providing a gate line 123 and a light emitting control line 124 for a row of pixel units as an example, but the display panel 100 of the present disclosure is not limited thereto. According to actual application requirements, the display panel 100 of the present disclosure may further be provided with two gate lines 123 and two light emitting control lines 124 for a row of pixel units. At this time, one gate line 123 and one light emitting control line 124 are electrically connected to the first pixel circuit 111, and the other gate line 123 and the other light emitting control line 124 are electrically connected to the second pixel circuit 112. FIG. 2 may be consulted for detailed specific settings, which are not described here.

(3) FIG. 3 and FIG. 5 exemplarily illustrate the display panel 100 using a one-side driving (that is, the first scanning sub-circuit 131 is disposed at one end of the gate line 123). However, the display panel 100 of the present disclosure is not limited to one-side driving. The display panel 100 provided by the present disclosure may also adopt a two-side driving (see FIG. 2) according to actual application requirements. At this time, a first scanning sub-circuit 131 is disposed respectively at each end of the gate line 123, and a second scanning sub-circuit 132 is disposed respectively at each end of the light emitting control line 124.

(4) FIG. 2, FIG. 3, and FIG. 5 each exemplify the display panel 100 by using a pixel unit group including two adjacent pixel units (that is, a first pixel unit and a second pixel unit) as an example. The display panel 100 of the present disclosure is not limited thereto. According to actual application requirements, the pixel unit group provided by some embodiments of the present disclosure may include three or more adjacent pixel units (for example, the first pixel unit, the second pixel unit, and the third pixel unit) in the extension direction of the first data line.

Figure 6:
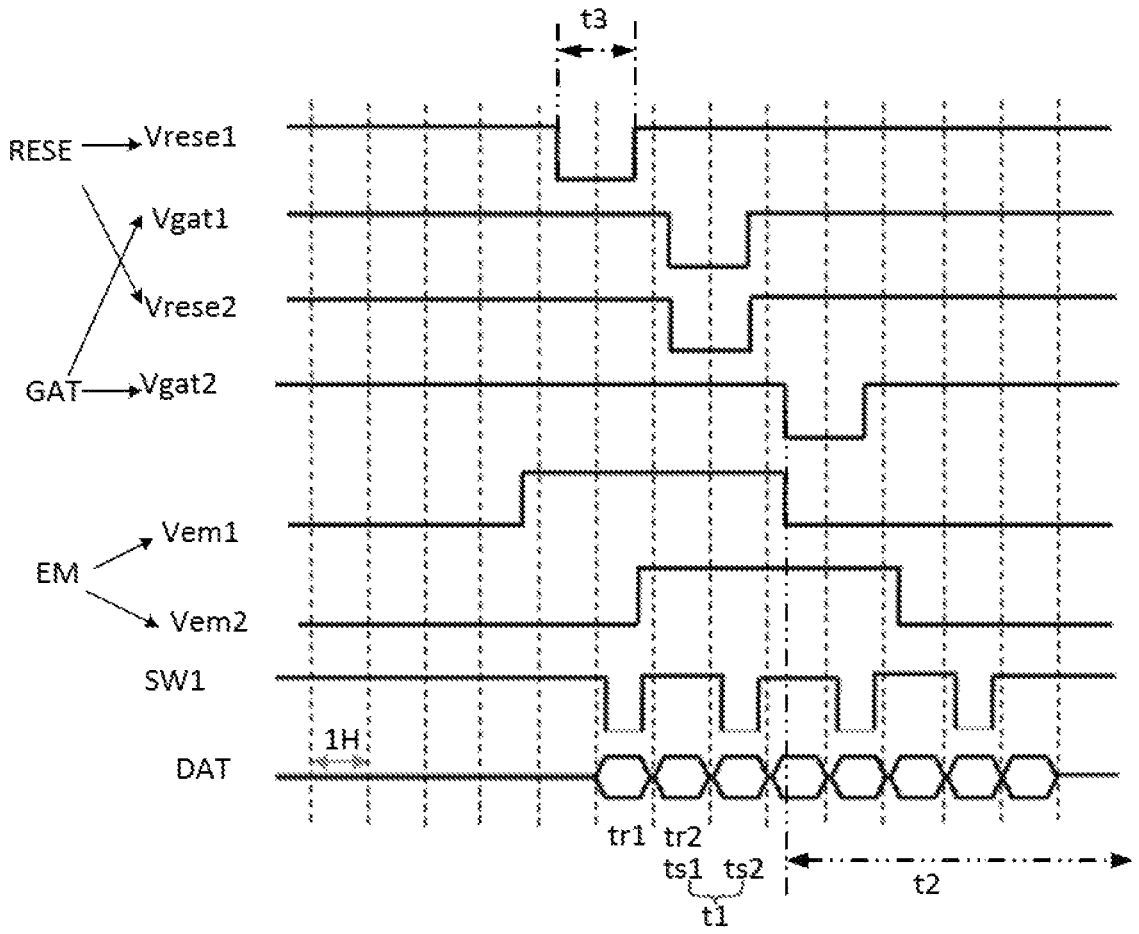
FIG. 6 is a driving timing chart of the display panel shown in FIG. 5 according to some embodiments of the present disclosure.

(5) In exemplifying the driving timing of the display panel of the present disclosure, the transistors included in the first pixel circuit and the second pixel circuit are all P-type transistors as an example. However, the embodiments of the present disclosure are not limited thereto. In the case where at least some of the transistors of the first pixel circuit and the second pixel circuit are N-type transistors, the driving timings shown in FIGS. 4 and 6 can be adaptively adjusted, and details thereto are not described herein again.

(6) The positional relationship among the first gate control terminal GAT1, the first light emitting control terminal EM1, the first reset control terminal RESE1, and the first data signal receiving terminal DAT1, and the positional relationship among the second gate control terminal GAT2, the second light emitting control terminal EM2, the second reset control terminal RESE2, and the second data signal receiving terminal DAT2 included in the second pixel circuit 112 shown in FIG. 3 and FIG. 5 are illustrated only as an example. According to actual application requirement, other positional relationships may also be adopted in the embodiments of the present disclosure.

Figure 7:
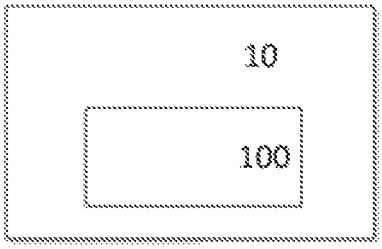
FIG. 7 is a schematic diagram of a display apparatus according to some embodiments of the present disclosure.

In some embodiments, FIG. 7 is a schematic illustration of a display apparatus 10 according to one embodiment of the present disclosure. The display apparatus 10 includes the display panel 100 of any one of the embodiments of the present disclosure and other indispensable components of the display apparatus 10 (for example, a thin film transistor control apparatus, a clock circuit, etc.), for which applicable conventional components may be employed. The display apparatus maintains the threshold compensation capability even when the refresh frequency is large, thereby improving the compensation effect and brightness evenness.

Figure 8:
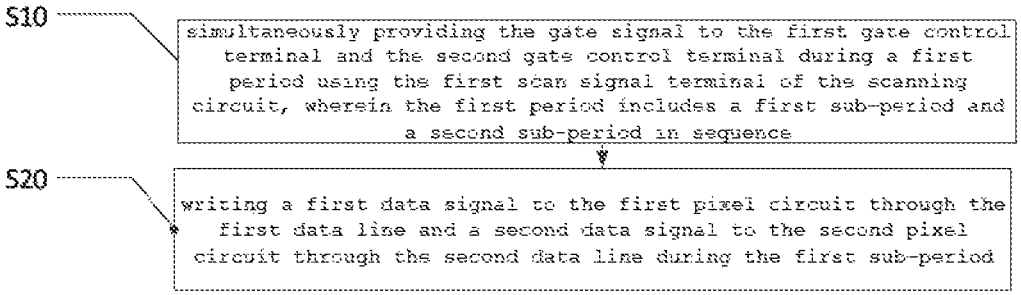
FIG. 8 is a schematic flowchart of a driving method of a display panel according to some embodiments of the present disclosure.

One embodiment of the present disclosure also provides a driving method of a display panel. As shown in FIG. 8, the driving method of the display panel includes the following steps:

Step S10 includes using the first scan signal terminal of the scanning circuit to simultaneously provide a gating signal to the first gate control terminal and the second gate control terminal in the first period.

Here, for example, the first period sequentially includes a first sub-period and a second sub-period.

Step S20 includes writing a first data signal to the first pixel circuit through the first data line and a second data signal to the second pixel circuit through the second data line in the first sub-period.

Figure 9:
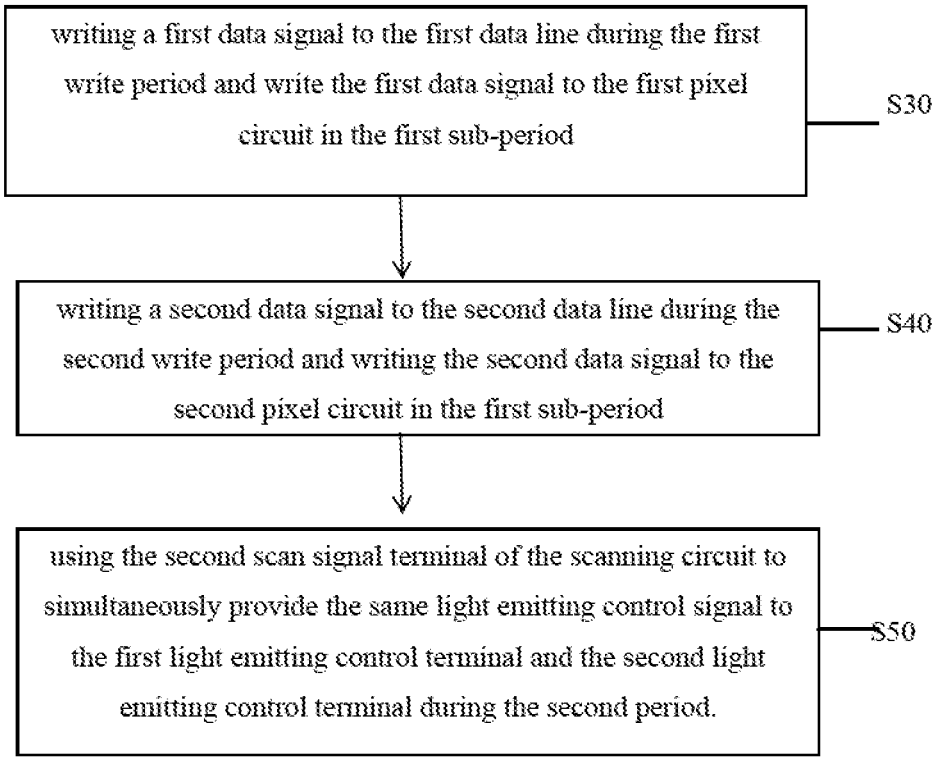
FIG. 9 is a schematic flowchart of a driving method of a display panel according to some embodiments of the present disclosure.

In some embodiments, as shown in FIG. 9, the driving method of the display panel further includes the following steps S30 and S40.

Step S30 includes writing a first data signal to the first data line during the first write period and write the first data signal to the first pixel circuit in the first sub-period.

Step S40 includes writing a second data signal to the second data line during the second write period and writing the second data signal to the second pixel circuit in the first sub-period.

In some embodiments, the first write period is prior to the first sub-period and is temporally adjacent to the first sub-period. The second write period is located in the first sub-period. In one embodiment, the second write period is located before the first sub-period and is temporally adjacent to the first sub-period; and the first write period is before the second write period and temporally adjacent to the second write period.

In some embodiments, as shown in FIG. 9, the driving method of the display panel may further include the following step S50.

Step S50: using the second scan signal terminal of the scanning circuit to simultaneously provide the same light emitting control signal to the first light emitting control terminal and the second light emitting control terminal during the second period.

For example, the first write period and the second write period are both equal to one half of the first period, and the first sub-period and the second sub-period are both equal to one-half of the first period.

In some embodiments, the driving method of the display panel further includes the following steps S301 and S401.

Step S301 includes connecting the first data line to the first data signal output terminal and writing the first data signal to the first data line during the first write period.

Step S401 includes connecting the second data line to the second data signal output terminal and writing the second data signal to the second data line during the second write period.

Some embodiments of the present disclosure provide a display panel, a driving method thereof, and a display apparatus. The display panel, the driving method thereof, and the display apparatus can maintain the threshold compensation capability of the display panel when the refresh frequency of the display panel is high, thereby improving the compensation effect and brightness evenness of the display panel and the display apparatus.

The disclosure has been described in detail above with the aid of the general description and specific embodiments. However, it will be apparent to those skilled in the art that modifications or improvements can be made thereto based on the embodiments of the present disclosure. Therefore, such modifications or improvements made without departing from the spirit of the present disclosure are intended to fall within the scope of the present disclosure.

The above is only an exemplary embodiment of the present disclosure, and is not intended to limit the scope of the present disclosure. The scope of the present disclosure is defined by the appended claims.

What is claimed is:

1. A display panel, comprising:

a pixel unit group, the pixel unit group comprising a first pixel unit and a second pixel unit, the first pixel unit and the second pixel unit respectively comprising a first pixel circuit and a second pixel circuit, the first pixel circuit comprising a first gate control terminal and a first light emitting control terminal, and the second pixel circuit comprising a second gate control terminal and a second light emitting control terminal;

a scanning circuit, the scanning circuit comprising a first scan signal terminal and a second scan signal terminal; and a first data line and a second data line;

wherein the first scan signal terminal is configured to simultaneously provide a same gate signal to the first pixel unit and the second pixel unit, and/or the second scan signal terminal is configured to simultaneously provide a same light emitting control signal to the first pixel unit and the second pixel unit;

the first data line is connected to the first pixel circuit, and the second data line is connected to the second pixel circuit;

the display panel is configured to simultaneously provide the same gate signal to the first gate control terminal and the second gate control terminal during a first period using the first scan signal terminal of the scanning circuit, and the first period includes a first sub-period and a second sub-period in sequence; and the display panel is further configured to write a first data signal to the first pixel circuit through the first data line and a second data signal to the second pixel circuit through the second data line during the first sub-period.

2. The display panel of claim 1, further comprising:

at least one gate line, wherein the first scan signal terminal is connected to the first gate control terminal and the second gate control terminal through the at least one gate line, and simultaneously provide the same gate signal to the first pixel unit and the second pixel unit through the at least one gate line.

3. The display panel of claim 2, further comprising:

at least one light emitting control line, wherein the second scan signal terminal is connected to the first light emitting control terminal and the second light emitting control terminal through the at least one light emitting control line, and simultaneously provide the same light emitting control signal to the first pixel unit and the second pixel unit.

4. The display panel of claim 1, further comprising a multiplexing circuit and a data driving circuit, wherein the data driving circuit comprises a first data signal output terminal, the multiplexing circuit is connected to the first data signal output terminal, the first data line and the second data line, and is configured to electrically connect the first data signal output terminal to the first data line and the second data line in a time-multiplexing manner.

5. The display panel of claim 4, wherein the multiplexing circuit comprises a first selection circuit and a second selection circuit, a first terminal of the first selection circuit is connected to the first data line, a first terminal of the second selection circuit is connected to the second data line, and second terminals of both the first selection circuit and the second selection circuit are connected to the first data signal output terminal.

6. The display panel of claim 5, wherein the first selection circuit comprises a first multiplexing transistor, and the second selection circuit comprises a second multiplexing transistor;

a first terminal and a second terminal of the first multiplexing transistor are respectively configured as the first terminal and the second terminal of the first selection circuit, and a first terminal and a second terminal of the second multiplexing transistor are respectively configured as the first terminal and the second terminal of the second selection circuit.

7. The display panel of claim 6, wherein a control terminal of the first multiplexing transistor and a control terminal of the second multiplexing transistor are configured to receive a same multiplexing control signal.

8. The display panel of claim 7, wherein the first multiplexing transistor and the second multiplexing transistor are of opposite types.

9. The display panel of claim 7, wherein the first multiplexing transistor and the second multiplexing transistor are of the same type.

10. The display panel according to claim 7, wherein the multiplexing circuit further comprises a multiplexing signal generating circuit, and the multiplexing signal generating circuit is configured to provide the same or inverted multiplexing control signal to the control terminals of the first multiplexing transistor and the second multiplexing transistor.

11. The display panel of claim 6, wherein a control terminal of the first multiplexing transistor and a control terminal of the second multiplexing transistor are configured to respectively receive a first multiplexing control signal and a second multiplexing control signal that are inverted from each other, and the first multiplexing transistor and the second multiplexing transistor are of the same type.

12. The display panel according to claim 1, wherein the scanning circuit comprises a first scanning sub-circuit and a second scanning sub-circuit, the first scanning sub-circuit comprises the first scan signal terminal, and the second scanning sub-circuit comprises the second scan signal terminal.

13. The display panel of claim 12, wherein the first scan sub-circuit comprises a first shift register unit which is configured to be cascaded and comprise the first scan signal terminal, and the second scan sub-circuit comprises a second shift register unit which is configured to be cascaded and comprise the second scan signal terminal.

14. A display apparatus, comprising the display panel of claim 1.

15. The display panel of claim 1, wherein to write the first data signal to the first pixel circuit through the first data line and the second data signal to the second pixel circuit through the second data line during the first sub-period comprises:

to write the first data signal to the first data line during a first write period and writing the first data signal to the first pixel circuit during the first sub-period; and to write the second data signal to the second data line during a second write period and writing the second data signal to the second pixel circuit during the first sub-period.

16. The display panel of claim 15, wherein, the first write period is located before the first sub-period and is temporally adjacent to the first sub-period, and the second write period is located in the first sub-period; or the second write period is located before the first sub-period and is temporally adjacent to the first sub-period, and the first write period is located before the second write period and is temporally adjacent to the second write period.

17. The display panel of claim 1, wherein the display panel is further configured to provide simultaneously the same light emitting control signal to the first light emitting control terminal and the second light emitting control terminal using the second scan signal terminal of the scanning circuit in a second period.

18. The display panel of claim 17, wherein the display panel further comprises a multiplexing circuit and a data driving circuit, the data driving circuit comprising a first data signal output terminal, the display panel is further configured:

to connect the first data line to the first data signal output terminal during the first write period to write the first data signal to the first data line; and to connect the second data line to the second data signal output terminal during the second write period to write the second data signal to the second data line.

* * * * *